US008860615B2

(12) United States Patent
Wang et al.

(10) Patent No.: US 8,860,615 B2
(45) Date of Patent: Oct. 14, 2014

(54) ANTENNA FOR VEHICLES

(71) Applicant: Harada Industry Co., Ltd., Tokyo (JP)

(72) Inventors: Jinsong Wang, Kanagawa (JP); Toshiro Yokoyama, Tokyo (JP); Toshihiro Iwabuchi, Niigata (JP); Junichi Kawahata, Kanagawa (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 13/682,958

(22) Filed: Nov. 21, 2012

(65) Prior Publication Data

US 2013/0076578 A1 Mar. 28, 2013

Related U.S. Application Data

(63) Continuation of application No. PCT/JP2011/061542, filed on May 19, 2011.

(30) Foreign Application Priority Data

May 21, 2010 (JP) ..... 2010-116980

(51) Int. Cl.
*H01Q 1/32* (2006.01)
*H01Q 9/30* (2006.01)

(52) U.S. Cl.
CPC . *H01Q 1/32* (2013.01); *H01Q 9/30* (2013.01); *H01Q 1/3275* (2013.01)
USPC ..... 343/715; 343/900

(58) Field of Classification Search
CPC .... H01Q 1/3275; H01Q 1/3258; H01Q 1/325
USPC ..... 343/711–713, 715, 875, 888, 900, 901
See application file for complete search history.

(56) References Cited

U.S. PATENT DOCUMENTS 5,616,043 A * 4/1997 Liou ..... 439/322
7,764,236 B2 * 7/2010 Hill et al. ..... 343/702

(Continued)

FOREIGN PATENT DOCUMENTS

CN 201041825 Y 3/2008
CN 201303049 Y 9/2009

(Continued)

OTHER PUBLICATIONS

International Search Report for PCT/JP2011/061542; Aug. 16, 2011.

(Continued)

*Primary Examiner* — Michael C Wimer
*Assistant Examiner* — Hasan Islam
(74) *Attorney, Agent, or Firm* — Pearne & Gordon LLP

(57) ABSTRACT

Disclosed is a type of antenna for vehicles that is protected by having a cap fitted-onto an antenna cover that covers an antenna element thereof, wherein coming-off of the cap is prevented from happening. The antenna for vehicles, which is comprised by having an antenna rod mounted onto an antenna base, is provided with: a conductive rod element that is formed within the antenna rod, and connected to the antenna base; a joint section that covers at least the side face of the rod element in the axis direction thereof, and that comprises an inner-side cylinder that is formed in the vicinity of an end section at the opposite side of the antenna base and further comprises a joint engaging section, and an outer-side cylinder that is formed at the outer side of the inner-side cylinder; and a rod cap that comprises a cop engaging section for engaging with the joint engaging section.

8 Claims, 5 Drawing Sheets

(56) References Cited

U.S. PATENT DOCUMENTS

| | | | | |
|---|---|---|---|---|
| 8,018,396 | B2 * | 9/2011 | Yu | 343/901 |
| 8,159,404 | B2 * | 4/2012 | Wakui | 343/715 |
| 2009/0267847 | A1 | 10/2009 | Sato et al. | |

FOREIGN PATENT DOCUMENTS

| | | | |
|---|---|---|---|
| JP | 2000-232313 | A | 8/2000 |
| JP | 2002-9524 | A | 1/2002 |
| JP | 2003-37412 | A | 2/2003 |
| JP | 2005-191656 | A | 7/2005 |
| JP | 2006-86566 | A | 3/2006 |
| JP | 2009-267601 | A | 11/2009 |

OTHER PUBLICATIONS

Examination Report for Application No. GB1220873.2 issued by UKIPO dated Jun. 20, 2013.

Chinese Office Action for Application No. CN201180025193.0 issued by SIPO dated Aug. 9, 2013.

Office Action issued in Chinese Patent Application No. 201180025193.0 dated Apr. 21, 2014.

Second Office Action issued in Chinese Patent Application No. 201180025193.0 dated Jan. 8, 2014.

* cited by examiner

ANTENNA FOR VEHICLES

CROSS-REFERENCE TO RELATED APPLICATION

This application is a U.S. continuation application filed under 35 USC 111(a) claiming benefit under 35 USC 120 and 365(c) of PCT application PCT/JP2011/061542, filed on May 19, 2011, the entire contents of which are incorporated herein by reference.

FIELD

The present invention relates to a vehicle antenna, and particularly to a technology that is favorably applied to an antenna of a type in which a cap is fitted on an antenna cover for covering antenna elements for protection.

BACKGROUND

It is conventionally known for vehicle antennas to cover a rod-like antenna element by means of an antenna cover made of a resin member for protection. One possible method for manufacturing such an antenna cover is integral molding using a mold and an antenna element. This is a method in which the antenna element is inserted into a mold for forming an antenna cover and then a resin is poured therein. An antenna cover thus manufactured is expected to exhibit high protection performance since the antenna element can be integrally covered from tip to base.

On the other hand, designs of vehicle antennas are deeply researched for to cope with marketing demands. Elements that determine design are considered to be shape, color and pattern, and it is possible to bring diversity to design on the vehicle antenna by, for instance, defining the shape of the antenna rod (that is, a portion of the rod-like antenna element mounted to the antenna base which is covered by the antenna cover) of the vehicle antenna to be conical or of triangular pyramid shape or fitting a cap to the antenna cover covering the antenna element that is of different color than that of the cover.

It is usually that vehicle antennas are weather-beaten over an extended time period and they are also often vandalized. When assembling the antenna rod by fitting a cap onto an antenna cover which covers an antenna element, it is necessary to improve the strength of the cap or the cover so as to prevent cases in which the cap comes off from the antenna cover.

For instance, Japanese Patent Laid-Open Publication No. 2005-191656 (referred as "patent document 1") discloses an antenna for portable wireless use which can be simply and easily fixed to a body without using any adhesive and from which ornamental cap does not come loose to make its appearance worse even after a long term of use. This antenna is arranged in that a joint is connected to an upper end of a whip element and in that a cap is overlaid onto an upper end of the joint, wherein a projection is formed on the cap side while a hole is formed on the joint side for fitting in overlaying the cap on the joint.

While the antenna for portable wireless use according to Patent Document 1 improves the design of the entire antenna by using an ornamental cap and is provided with a projection and a hole on the cap and the antenna, respectively, for preventing falling off of the cap, such fixation provided by the projection and the hole may be affected when force is applied from the exterior of the antenna so that the cap falls off.

In view of the above circumstances, it is an object of the present invention to prevent falling off of a cap in a vehicle antenna of a type in which a cap is fitted onto an antenna cover that covers the antenna element for protection.

SUMMARY

The vehicle antenna according to the present invention is a vehicle antenna that is configured of an antenna rod that is fitted to an antenna base, the vehicle antenna comprising: a conductive rod element that is provided within the antenna rod and connected to the antenna base; a joint member having an inner tubular portion that covers at least an outer peripheral surface of the rod element, that is provided at a vicinity of an end of the joint member opposite to the antenna base and that includes a joint engaging portion and an outer tubular portion provided outside of the inner tubular portion; and a rod cap having a cap engaging portion that engages with the joint engaging portion.

The above vehicle antenna may also be arranged in that the joint member includes a joint outer peripheral portion having a convex portion that is provided on an outer peripheral surface of the joint member and that projects towards the rod cap. The rod cap includes a cap outer peripheral portion including a concave portion on a surface that contacts the convex portion. Engagement of the joint engaging portion and cap engaging portion makes the joint outer peripheral portion and the cap outer peripheral portion fit with each other.

The above vehicle antenna may also be arranged in that the joint member and the rod cap are at least prevented from mutual positional shift in peripheral directions by means of a restricting means.

The above vehicle antenna may also be arranged in that the antenna rod includes a rod cover that covers at least an outer peripheral surface of the joint member and that mutual positions of the joint member and the rod cover are fixed by means of a fixing means.

The above vehicle antenna may also be arranged in that the fixing means include a cover fixing portion provided to the rod cover so as to face the joint member and a joint fixing portion that is provided on a surface of the joint member opposing the cover fixing portion.

The above vehicle antenna may also be arranged in that the rod cover has a convex portion that is provided on an outer peripheral surface of the rod cover projecting towards the rod cap, in that the rod cap includes a concave portion on a surface that comes into contact with the convex portion wherein the convex portion and the concave portion fit with each other, with the joint engaging portion and the cap engaging portion being engaged with each other.

The above vehicle antenna may also be arranged in that the joint member and/or the rod cover are integrally molded of resin and cover at least the outer peripheral surface of the rod element.

According to the present invention, it is possible to prevent a cap from falling out of a vehicle antenna of a type in which a cap is fitted onto an antenna cover that covers an antenna element for protection.

DESCRIPTION OF EMBODIMENT

Figure 1:
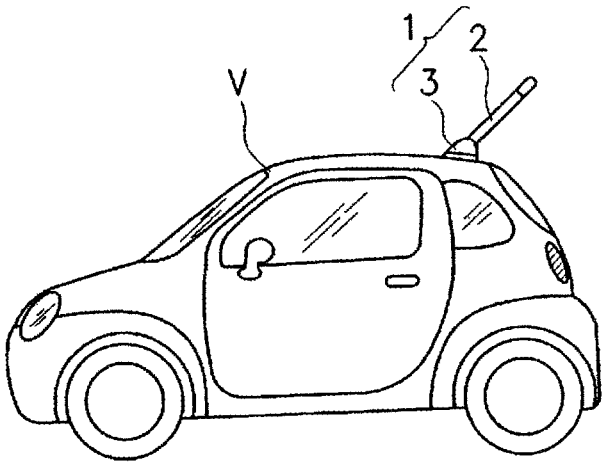
FIG. 1 is a view showing a condition in which a vehicle antenna according to an embodiment of the present invention is mounted on a vehicle.

As shown in FIG. 1, a vehicle antenna according to one embodiment of the present invention is configured in that an antenna rod 2 is attached to an antenna base 3 mounted to a roof of a vehicle V, and is particularly characterized by the configuration of the antenna rod 2. While embodiments of the present invention will now be explained with reference to the drawings, a rod-like antenna element is referred to as a rod element, an antenna cap as a rod cap, a structure that covers an outer peripheral surface of the rod element and that fits with the rod cap as a joint member, and a structure that covers an outer peripheral surface of the joint member as a rod cover, respectively.

[First Embodiment]

According to the first embodiment of the present invention, the antenna rod is configured in that the rod element is covered by the joint member and that the rod cap is overlaid onto a tip end (that is, end portion opposite to the side at which it is mounted to the antenna base) of the joint member.

Figure 2:
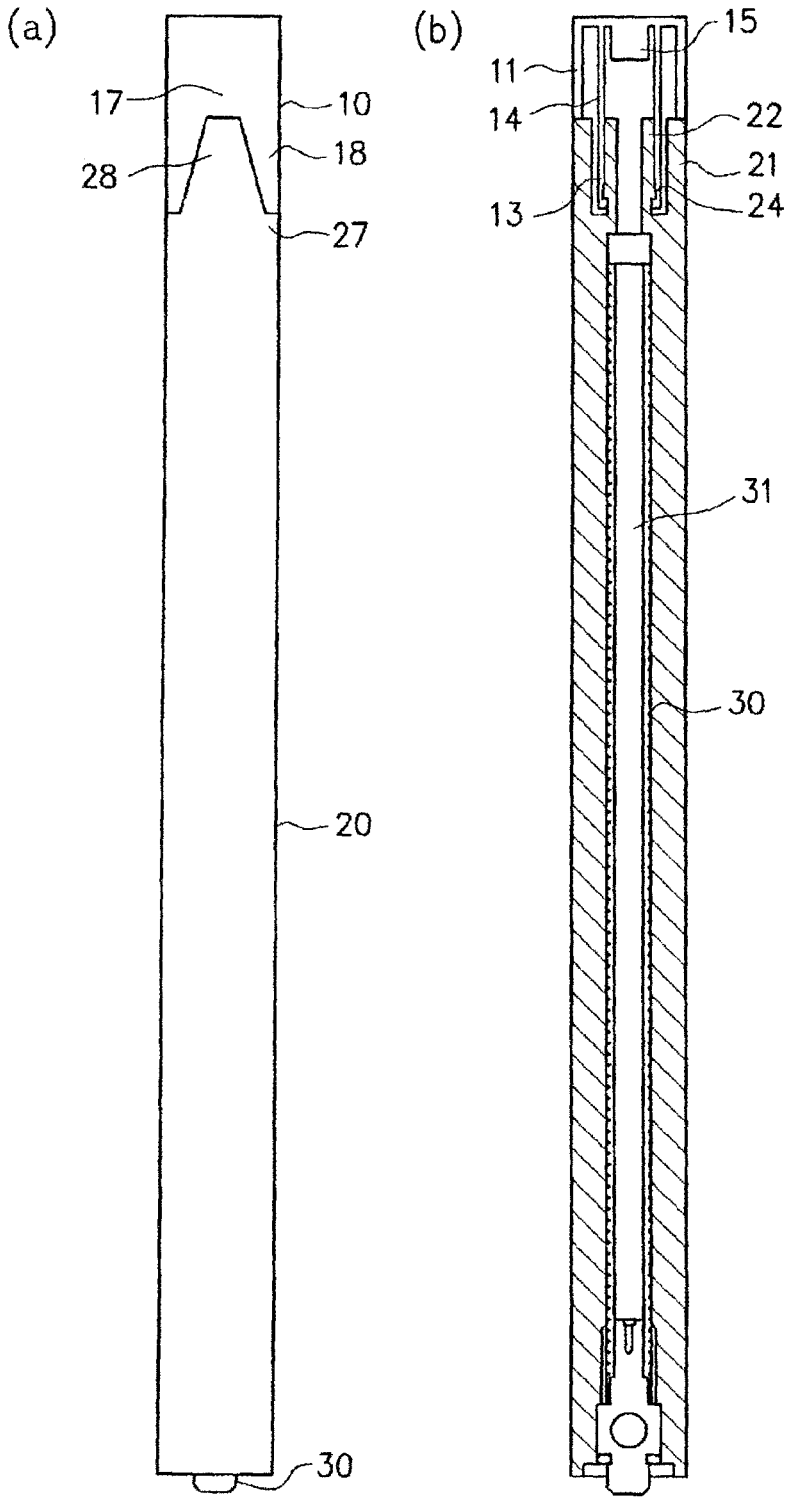
FIG. 2 is a front view and a sectional view of an antenna rod of a vehicle antenna according to an embodiment of the present invention.

FIG. 2 is a view showing a configuration of the antenna rod of a vehicle antenna according to the present embodiment, wherein FIG. 2(*a*) illustrates a front view and FIG. 2(*b*) illustrates a sectional view. The antenna rod of the present embodiment is comprised of a conductive rod element 30 that is connected to the antenna base, an insulating joint member 20 that covers the rod element 30, and a rod cap 10 that is overlaid onto a tip end of the joint member 20.

Figure 3:
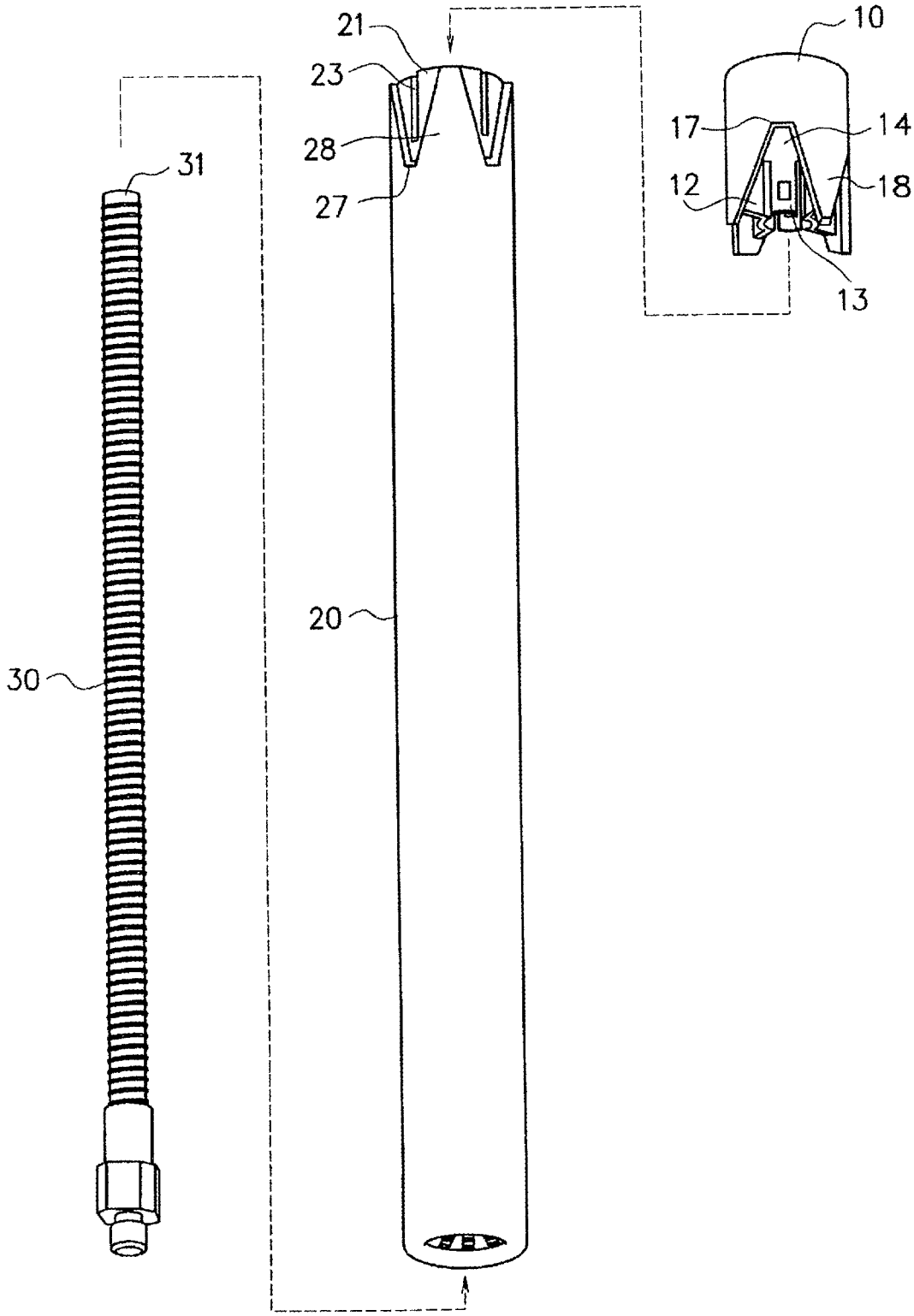
FIG. 3 is an exploded perspective view of an antenna rod of a vehicle antenna according to an embodiment of the present invention.

The rod element 30 is arranged in that a conductive material (element) is wound around a shaft portion 31 of resin member to comprise a rod-like antenna rod 3 to be attached to the antenna base 2 (FIG. 3). It is, however, possible to be formed in various shapes such as that having circular or polygonal sections perpendicular to the axial direction, as long as radio emission performances are not affected. A base end is connected to a tuner via a cable (not shown).

The joint member 20 has a substantially cylindrical shape formed with a hollow capable of accumulating the rod element 30 therein. In general, a cover for covering an antenna element needs to have a uniform thickness for improving the degree of perfection of finish (for beautifully finishing), so that the joint member 20 for covering the rod element 30 is configured to have a uniform thickness also in the present embodiment.

The tip end of the joint member 20 is fitted with the rod cap 10 like a lid and is also provided with a structure for preventing rod cap 10 from falling out and rotating around the joint member 20. More specifically, there are formed an outer tubular portion 21 and inner tubular portion 22 having substantially cylindrical shapes of different radii, wherein a joint engaging portion 24 is provided on an outer surface of the inner tubular portion 22 for engagement with the rod cap 10 while a joint restricting portion 23 (FIG. 3) for engagement with the rod cap 10 is formed at an end portion of the outer tubular portion 21. At the inner tubular portion 22, the joint engaging portion 24 prevents the rod cap 10 from falling out of itself and, at the outer tubular portion 21, the joint restricting portion 23 prevents the rod cap 10 from rotating (that is, positional shifting). The joint member 20 includes a joint outer peripheral portion on its outer peripheral surface parallel to its axis, and which is formed as a trapezoid composed of a joint concave portion 27 and a joint convex portion 28 respectively contacting to the rod cap 10.

The rod cap 10 has a shape corresponding to a columnar shape which is hollowed out with leaving a wall of a specific thickness. A portion (that is, cap outer peripheral portion 11) of the rod cap 10 that comes into contact with the joint member 20 is formed as a trapezoid comprising a cap concave portion 17 and a cap convex portion 18. When the rod cap 10 engages with the joint member 20, the concaves and convexes of the cap outer peripheral portion 11 are fitted with the convex and concave of the joint outer peripheral portion, so that a columnar shaped antenna rod 2 is assembled. As for the shape of the portion of the rod cap 10 that comes into contact with the joint member 20, it is possible to be formed in a shape other than a trapezoid such as a square (for instance, rectangular) shape, a triangular shape or curves such as waveforms for hardly allowing the rod cap 10 to rotate to the joint member 20, while also ensuring freedom of design.

In the interior of the rod cap 10, a base portion 14 for supporting a cap engaging portion 13 that engages with the joint engaging portion 24 and a cap restricting portion 12 (FIG. 3) that is inserted into the joint restricting portion 23 is integrally provided with the cap outer peripheral portion 11. In this manner, since respective portions are integrally formed, the rod cap 10 is fixed in a condition in which it overlays the joint member 20 so that the cap outer peripheral portion 11 will be prevented from separately falling out and rotating to the joint member 20.

FIG. 3 is an exploded perspective view of the antenna rod of the vehicle antenna according to the present embodiment. First, the rod element 30 is wound around the shaft portion 31 and is inserted into the hollow from the lower end of the joint member 20 (that is, in direction reverse to that in which the cap is overlaid on the joint member 20). The rod cap 10 is then overlaid to the joint member 20 from above.

Here, when overlaying the joint member 20, the cap restricting portion 12 is inserted into the joint restricting portion 23 at a position at which the cap engaging portion 13 and the joint engaging portion 24 (FIG. 2) meet to each other. Alignment of the cap engaging portion 13 to the joint engaging portion 24 (FIG. 2) is made easy by such inserting of the cap restricting portion 12 into the joint restricting portion 23. In this respect, a shaft may be provided on a cap bottom portion 15 inside the rod cap 10 so as to project toward the joint side, so that it may be possible to use the shaft as a guide for the alignment, as a guide for fitting or as a hanger used at the time when manufacturing (particularly painting) the rod cap 10.

According to the present embodiment, a tip end (tip end on a side opposing the rod cap) of the inner tubular portion 22 of the joint member 20 is open while a tip end (that is, a tip end at which the joint member 20 is mounted) of the rod element 30 is covered by the joint member 20. It is possible to arrange the tip end of the inner tubular portion 22 to be close. It is also possible to arrange the tip end of the rod element 30 to be projecting further outward than the tip end of the joint member 20 (such that the joint member 20 covers the outer peripheral surface of the rod element 30 parallel to its axis but not the tip end). It is also possible to arrange the inner tubular portion 22 such that its tip end is slightly tapered than the outer tubular portion 21 towards the rod cap side, wherein such a tapered tip end will serve as an axial guide of the rod cap engaging portion 13.

Figure 4:
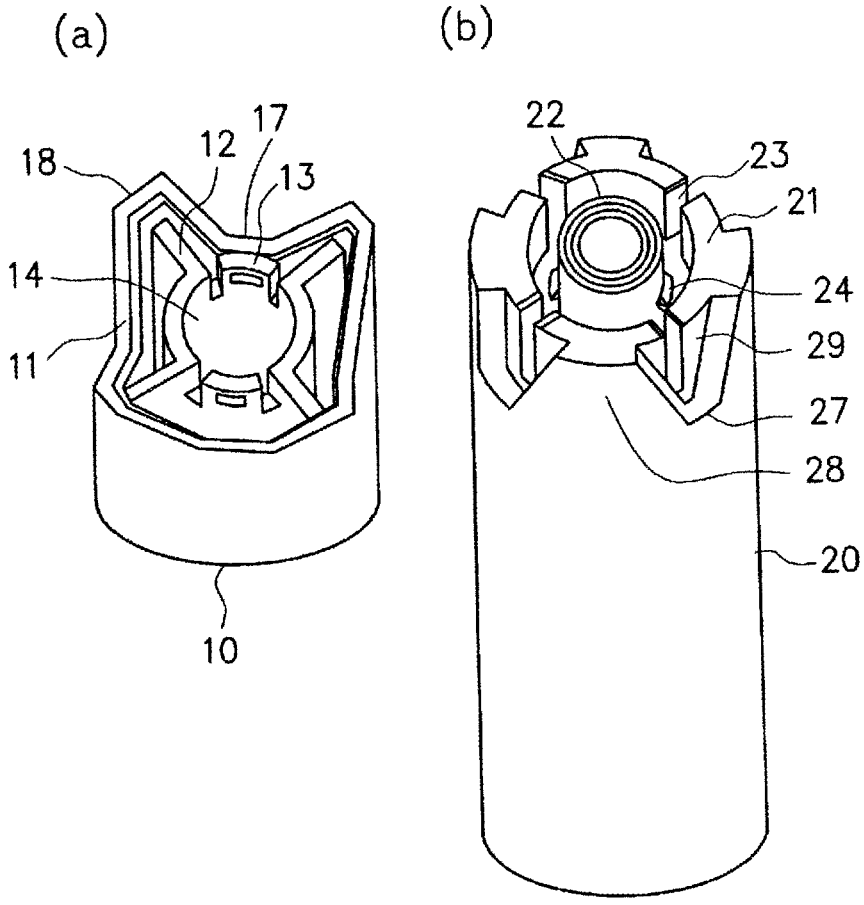
FIG. 4 is a perspective view of a rod cap and a joint member of a vehicle antenna according to an embodiment of the present invention.

FIG. 4 is a view showing a configuration of the antenna rod of the vehicle antenna according to the present embodiment, wherein FIG. 4(*a*) illustrates a perspective view of the rod cap and FIG. 4(*b*) illustrates a perspective view of the joint member. According to the present invention, the configuration of the rod cap and the joint member as shown in FIG. 4 prevents the rod cap from falling out of and rotating to the joint member, as well as curling of the cap outer peripheral portion and the joint outer peripheral portion.

First, prevention of falling out will be explained. As shown in FIG. 4(*a*), a substantially cylindrical base portion 14 provided inside the rod cap 10 supports the cap restricting portion 12 and the cap engaging portion 13. A radius of an inner peripheral surface of the base portion 14 is substantially identical to a radius of an outer peripheral surface of the inner tubular portion 22 so that when the rod cap 10 is overlaid, the inner peripheral surface of the base portion 14 and the outer peripheral surface of the inner tubular portion 22 will be closely fitted to each other. The joint engaging portion 24 includes a projection while the cap engaging portion 13 includes a hole that fits with the projection. The cap engaging portion 13 elastically deforms outwardly (in direction of increasing the radius) immediately before the hole fits with the projection of the joint engaging portion 24 when the base portion 14 is inserted into the inner tubular portion 22.

On the other hand, as shown in FIG. 4(*b*), the joint member 20 is arranged such that the joint engaging portion 24 located on the outer peripheral surface of the inner tubular portion 22 is formed with a projection that fits with the hole of the cap engaging portion 13. This projection has a shape (that is, substantially a triangular pole when seen from a side surface of the surface on which the projection is formed) in which the projection becomes gradually larger in coming further downward (in direction approaching an end opposite to a surface opposing the rod cap 10). With this shape of the projection, it can be easily pushed in when the rod cap 10 is overlaid to the joint member 20 while it comes hardly off once the projection of the joint engaging portion 24 and the hole of the cap engaging portion 13 are engaged each other, so that the overlaid rod cap 10 is fixed to the joint member 20. Moreover, since the hole engaged with the projection is formed in the inner tubular portion 22 and the outer tubular portion 21 serves to intercept transmission of external force from outside to the inner tubular portion 22, external force will not cause the rod cap 10 to falling out of the joint member 20.

The structure for preventing the rod cap from falling out of the joint member 20, that is, the structure and position of the joint engaging portion 24 or the cap engaging portion 13 may be different from those as described above. It is, for instance, possible to provide the projection on the cap engaging portion 13 and the hole on the joint engaging portion 24. It is also possible to provide a projection or a hole on an outer peripheral surface of the shaft portion 16 of the rod cap 10 and to provide a corresponding hole or a projection on the inner peripheral surface of the inner tubular portion 22 of the joint member 20. A structure for fitting the cap with the cover may also be arranged in that only projections or holes are provided on both members or in which shapes combining projections and holes are provided on both members.

Next, prevention of rotation of the rod cap will now be explained. As shown in FIG. 4(*a*), the cap restricting portion 12 of the rod cap 10 is supported at the substantially cylindrical base 14 and is integrally formed therewith and is further integrally formed with the cap outer peripheral portion 11. On the other hand, as shown in FIG. 4(*b*), the joint member 20 is arranged in that the joint restricting portion 23 is formed at an end portion of the outer tubular portion 21 on an opposing surface of the rod cap 10 which is a portion with small thickness.

The cap restricting portion 12 is plate-like portion while the joint restricting portion 23 is a notch. A width of the joint restricting portion 23 is substantially identical to a width of the cap restricting portion 12, so that the side surface of the cap restricting portion 12 and the side surface of the joint restricting portion 23 will be closely attached to each other when the rod cap 10 is overlaid on the joint member 20. Since the cap restricting portion 12 and the joint restricting portion 23 are engaged each other in a condition closely contacted to each other and the joint restricting portion 23 is integrally formed with the base portion 14 and the cap outer peripheral portion 11, the rod cap 10 will not rotate in a condition overlaid on the joint member 20.

The structure for preventing the rod cap 10 from rotating, that is, the structure and position of the cap restricting portion 12 or the joint restricting portion 23 may be different from those as described above. It is, for instance, possible to form the cap restricting portion 12 at the outer tubular portion 21 as a projection and the joint restricting portion 23 as a hole and vice versa (to form the cap restricting portion 12 as a hole and the joint restricting portion 23 as a projection). It is preferable to provide a projection having a length by an order by which rotation of the rod cap 10 fitted on the joint member 20 is prevented and to provide a hole of corresponding depth. It is also possible to provide the joint restricting portion 23 on the inner tubular portion 22, and to comprise the structure with a plate shape-shaped portion and a notch or with a projection and a hole. In case a plate shape and a notch are used for the structure, a notch similar to the above-mentioned one that is provided at the outer tubular portion 21 is formed on the inner tubular portion 22 while the shaft portion 16 of the rod cap 10 is formed as a plate that fits the notch. For instance, notches are provided at two positions (that are, positions at every 180 degrees), the cap side may be provided with a single plate-like member. When there are four notches (positions at every 90 degrees), the cap may be provided with two plate-like members being crossed.

Now, preventing the rod cap from curling will be explained. According to the present embodiment, a portion of the cap outer peripheral portion 11 that contacts the joint member 20 is formed of a trapezoidal concave and convex wherein the cap convex portion 18 (that is, a trapezoidal portion extending downward in case overlaid onto the joint member 20) may be curled when weather-beaten over an extended time period. Accordingly, as shown in FIG. 4(*a*), the cap restricting portion 12 of the rod cap 10 is integrally formed with the substantially cylindrical base 14 and the cap outer peripheral portion 11 at a position corresponding to the cap convex portion 18. Since this integral forming with the cap outer peripheral portion 11, curling of the cap convex portion 18 of the cap outer peripheral portion 11 in a condition in which the rod cap 10 is overlaid is prevented. It also serves to maintain the shape of the rod cap 10.

Next, curl prevention of the joint will now be explained. The joint outer tubular portion 21 is arranged in that a portion thereof that contacts the cap outer peripheral portion 11 of the rod cap 10 on the joint outer peripheral portion (that is, a cap concave portion 17 and cap convex portion 18) is formed of a trapezoidal concave and convex, so that the joint convex portion 28 (that is, a trapezoidal portion extending towards the rod cap 10 side) may be curled when weather-beaten over an extended time period. Accordingly, as shown in FIG. 4(*b*), a width (that is, thickness of the a tubular portion) of the joint convex portion 28 in a perpendicular direction with respect to the antenna rod shaft is defined to be larger than a width (thickness as a tubular portion) of a joint thin wall portion 29 (a portion extending from the joint concave portion 27 to the tip end of the joint) that extends from the joint convex portion 28 in a peripheral direction of the antenna rod and at which the joint restricting portion 23 is formed. Accordingly, by engaging the rod cap 10 and the joint member 20 with each other, the joint thin wall portion 29 is covered by the cap convex portion 18 and by pinching the same by means of the base portion 14 of the rod cap 10 from the opposite side of the cap convex portion 18, the joint convex portion 28 is fixed to the joint cap 10. The joint convex portion 28 is accordingly prevented from curling outward so that it also serves to maintain the shape of the joint member 20. In this respect, while the above-mentioned joint member 20 has been manufactured separately from the rod element 30, it is also possible to insert the rod element 30 into a mold for forming the joint member 20 and to pour a resin member for manufacture.

[Second Embodiment]

According to the second embodiment of the present invention, the antenna rod is configured in that a rod element is covered by a joint member, and the joint member is covered by a rod cover and in that a rod cap is overlaid onto a tip of the joint member and the rod cover (tip end opposite to a side at which it is mounted to an antenna base).

In the first embodiment, only the joint member was used, so that the joint member will be of fixed shape (for instance, columnar) due to the necessity of making the thickness of the cover uniform. In the second embodiment, since a rod cover is further made to cover the joint member, it is possible to grand a degree of freedom to the shape of the antenna rod. More specifically, the shape of the antenna rod may be a reversed truncated cone or a rounded shape such as a gourd shape. Even if finishing of products may become problematic in view of uniformity of the cover thickness in case a reserved truncated cone shape or gourd shape is to be realized by the joint member alone, it is possible to assemble an antenna rod of desired shape and high perfection while maintaining its thickness uniform by adopting a structure in which the joint member is further covered with a rod cover.

On the other hand, when covering the joint member with the rod cover, it is necessary to take measures to prevent the rod cover from falling out of the joint member, from rotating and from curling.

Figure 5:
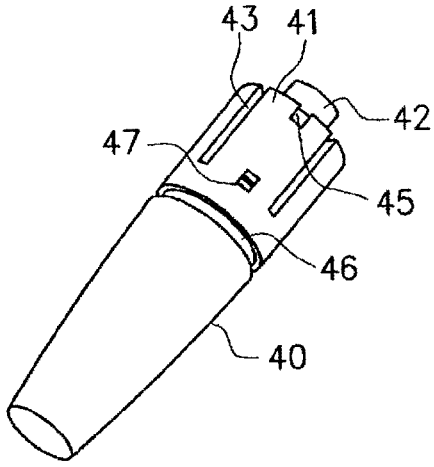
FIG. 5 is a perspective view of a joint member of a vehicle antenna according to an embodiment of the present invention.

FIG. 5 is a perspective view of a joint member of a vehicle antenna according to the present embodiment. At a cap opposing surface, a joint member 40 according to the present embodiment has a structure that is identical to that of the joint member 20 of the first embodiment. More specifically, it comprises an outer tubular portion 41 and an inner tubular portion 42, and a joint engaging portion 44 for preventing a rod cap 10 from falling out of the joint member 20 (FIG. 6) is provided on an outer peripheral surface of the inner tubular portion 42 while a joint restricting portion 43 for preventing the rod cap 10 from rotation is formed at a tip end of the outer tubular portion 41. The difference from the joint member 20 of the first embodiment resides in the point that the joint member 40 does not cover the entire rod element 30 but only covers an end portion opposite to an end mounted to the antenna base and a part of an outer peripheral surface parallel to its axis (while the rest of the rod element 3 is covered by the rod cover).

The joint member 40 also includes a structure for preventing the rod cover 50 (FIG. 6) covering itself from falling out, rotating and curling. A joint fixing portion 45 is provided at the outer tubular portion 41 at an end that is not formed with the joint restricting portion 43 which engages with a cover fixing portion 51 at an end portion of the rod cover 50 (FIG. 6) for preventing the rod cover 50 from curling and rotating. The joint fixing portion 45 is configured as a hole and the cover fixing portion 51 is configured as a projection. By further providing joint fixing portions 46 and 47 at an intermediate position between both end portions of the joint (portion) 40, falling out of the rod cover 50 is further prevented. The joint fixing portion 46 is configured as a peripheral notch while the joint fixing portion 47 is configured as a hole. In this respect, the joint fixing portion 47 may be used as a working space for forming the joint engaging portion 44 (FIG. 6) on the outer side surface of the inner tubular portion 42 until the rod cover 50 is formed through integral molding as it will be discussed later.

Figure 6:
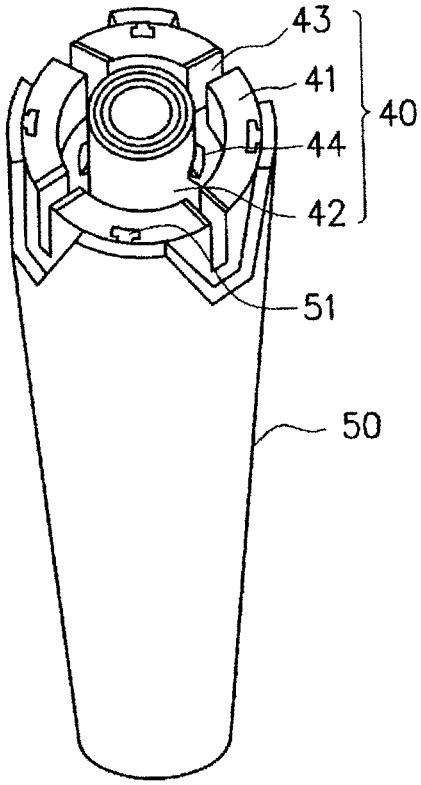
FIG. 6 is a perspective view of a joint member and a rod cover of a vehicle antenna according to an embodiment of the present invention.

FIG. 6 is a perspective view of the joint member and the rod cover of a vehicle antenna according to the present embodiment. The rod cover 50 is covered in a condition in which the joint member 40 partially covers the rod element 30. In this respect, the rod cover 50 may be formed by means of an integral molding method as described above, more specifically, by inserting the rod element 30 with the joint member 40 into a mold for forming the antenna cover and by pouring a resin member therein. In such instance, the resin member flows into the joint fixing portions 45, 46 and 47 of the joint member 40 so that projections corresponding to the respective portions are formed on the rod cover 50.

The rod cap 10 includes a cap outer peripheral portion 11 having a trapezoidal convex and concave edge. The rod cover 50 is provided with a cover outer peripheral portion of which part contacting the cap outer peripheral portion 11 is comprised of a trapezoidal convex and concave at an outer peripheral surface parallel to its axis, similar to the first embodiment. When the rod cap 10 engages with the joint member 40, the convexes and concaves of the cap outer peripheral portion 11 are engaged with the cover outer peripheral portion fit, so that a columnar antenna rod 2 is assembled. As it was the case with the first embodiment, a shape of the cap outer peripheral portion 11 and the cover outer peripheral portion may be a quadrilateral other than a trapezoid (for instance, rectangular), a triangular shape or curves such as waveforms.

Further, while no joint outer peripheral portion (FIG. 4(*b*)) having a trapezoidal convex and concave edge is provided at the joint member 40 in FIG. 5, it is possible to adopt a structure in which the joint outer peripheral portion is provided. In such instance, it is possible to adopt a structure in which the rod cover 50 covers an outer peripheral surface parallel to the axis of the joint outer peripheral portion, other than a part having the trapezoidal convex and concave edge or a structure in which the rod cover 50 covers the entire joint member 40 including the joint outer peripheral portion. In this respect, in the latter case, a trapezoidal convex and concave edge is formed along the trapezoidal convex and concave edge of the joint outer peripheral portion, and when the rod cap 10 engages with the joint member 40, the convex and concave of the cap outer peripheral portion 11 and the convex and concave edges of the joint outer peripheral portion and the cover outer peripheral portion.

The structure for preventing the rod cover from falling out, rotating and curling, that is, the structure and position of the joint fixing portions 45, 46 and 47 and the cover fixing portion 51 may be different from those described above, and it is also possible to form the joint fixing portions 45, 46 and 47 as projections while forming the cover fixing portion 51 as a hole. It is also possible to form a plurality of axial notches below the joint fixing portion 46 (at a side where it is fixed to the antenna base) as an additional joint fixing portion in order to improve rotation preventing effects. In such instance, projections corresponding to the axial notches are formed at the rod cover 50 through integral molding, so that the rod cover 50 that covers the joint member 40 may more hardly be peripherally rotated in comparison with a case only the joint fixing portions 45, 46 are provided. It is also possible to employ an adhesive instead of the above-mentioned structure or to concurrently use this structure and an adhesive.

As discussed above, according to this embodiment, the joint member 40 and the rod cover 50 are used as a means for covering an antenna element, so that it is possible to grant freedom of degree for the shape of the antenna rod and to improve its design. Moreover, since the joint member 40 has a structure similar to the joint member 20 of the first embodiment (which is a double layered structure composed of the outer tubular portion and the inner tubular portion), it is possible to prevent the rod cap 10 from falling out by eliminating effects of external force and from rotating. By the provision of joint fixing portions consisting of holes and notches formed on the outer peripheral surface of the joint member 40, it is possible to prevent the rod cap 10 from falling out, rotating and curling.

In this respect, it should be noted that the above embodiments are preferred embodiments of the present invention while the scope of the present invention is not to be limited to the embodiments, and it is possible to perform variously changing of the embodiments without departing from the gist of the present invention.

What is claimed is:

1. A vehicle antenna configured of an antenna rod fitted to an antenna base, the vehicle antenna comprising:

a conductive rod element provided within the antenna rod and connected to the antenna base;

a joint member covering at least an outer peripheral surface of the rod element, the joint member also having an inner tubular portion and an outer tubular portion surrounding the inner tubular portion, the inner tubular portion being provided at a vicinity of an end of the joint member opposite to the antenna base and including a joint engaging portion, the outer tubular portion including a joint restricting portion provided on a joint thin wall portion, the joint engaging portion provided between the inner tubular portion and the outer tubular portion; and a rod cap having a cap engaging portion engaging with the joint engaging portion and a cap restricting portion engaging with the joint restricting portion so as to project toward the joint restricting portion, the rod cap also having a base portion including the cap engaging portion and a cap outer peripheral portion surrounding the base portion that covers the joint thin wall portion, the base portion supporting the cap engaging portion and the cap restricting portion, the cap restricting portion integrally provided with the cap outer peripheral portion, wherein the antenna rod comprises the joint member and the rod cap.

2. The vehicle antenna as claimed in claim 1, wherein the joint member includes a joint outer peripheral portion including a joint convex portion provided on an outer peripheral surface of the outer tubular portion and projecting towards the rod cap in an axial direction of the outer tubular portion, wherein the cap outer peripheral portion including a cap concave portion fitting to the joint convex portion on a surface contacting the joint convex portion, and wherein engagement of the joint engaging portion and the cap engaging portion makes the joint outer peripheral portion and the cap outer peripheral portion fit with each other.

3. The vehicle antenna as claimed in claim 1, wherein the joint member and the rod cap are at least prevented from mutual positional shift in peripheral directions by means of a restricting means.

4. The vehicle antenna as claimed in claim 1, wherein the antenna rod includes a tubular rod cover covering at least an outer peripheral surface of the joint member, and wherein mutual positions of the joint member and the rod cap are fixed by a fixing means.

5. The vehicle antenna as claimed in claim 4, wherein the fixing means include a cover fixing portion provided to the rod cover so as to face the joint member and a joint fixing portion provided on a surface of the joint member opposing the cover fixing portion.

6. The vehicle antenna as claimed in claim 4, wherein the rod cover has a cover fitting convex portion provided on an inner peripheral surface of the rod cover projecting towards the rod cap, wherein the rod cap includes a cover fitting concave portion on a surface contacting with the convex portion, and wherein the cover fitting convex portion and the cover fitting concave portion fit with each other, with the joint engaging portion and the cap engaging portion being engaged with each other.

7. The vehicle antenna as claimed in claim 4, wherein the joint member and/or the rod cover are integrally molded of resin and covers at least the outer peripheral surface of the rod element.

8. The vehicle antenna as claimed in claim 1, wherein the outer tubular portion is opposed to the inner tubular portion through a gap formed between the outer tubular portion and the inner tubular portion.

* * * * *